US008152324B2

(12) United States Patent
Franklin et al.

(10) Patent No.: US 8,152,324 B2
(45) Date of Patent: Apr. 10, 2012

(54) ROD ASSEMBLY CONNECTOR FOR MOUNTING LIGHT EMITTING DISPLAY APPARATUSES

(75) Inventors: Douglas Franklin, Austin, TX (US); Christopher Varrin, Los Gatos, CA (US); Matthew Ward, Philadelphia, PA (US); Jeremy Hochman, Austin, TX (US); Jeffrey T. Maddox, Austin, TX (US)

(73) Assignee: Barco, Inc., Duluth, GA (US)

( * ) Notice: Subject to any disclaimer, the term of this patent is extended or adjusted under 35 U.S.C. 154(b) by 332 days.

(21) Appl. No.: 12/530,184

(22) PCT Filed: Jan. 11, 2008 (Under 37 CFR 1.47)

(86) PCT No.: PCT/US2008/050904

§ 371 (c)(1), (2), (4) Date: Sep. 4, 2009

(87) PCT Pub. No.: WO2008/089092

PCT Pub. Date: Jul. 24, 2008

(65) Prior Publication Data

US 2010/0135032 A1 Jun. 3, 2010

Related U.S. Application Data

(60) Provisional application No. 60/884,856, filed on Jan. 12, 2007.

(51) Int. Cl.
*F21S 8/00* (2006.01)

(52) U.S. Cl. ..... 362/147; 362/249.01

(58) Field of Classification Search ..... 362/145, 362/147, 219, 249.01, 249.02
See application file for complete search history.

(56) References Cited

U.S. PATENT DOCUMENTS

| | | | | |
|---|---|---|---|---|
| 2,501,485 | A * | 3/1950 | Tuck | 362/219 |
| 4,748,545 | A * | 5/1988 | Schmitt | 362/219 |
| 5,554,049 | A | 9/1996 | Reynolds | |
| 5,666,453 | A | 9/1997 | Dannenmann | |
| 6,237,290 | B1 | 5/2001 | Tokimoto et al. | |
| 6,314,669 | B1 | 11/2001 | Tucker | |
| 6,704,989 | B1 | 3/2004 | Lutz et al. | |
| 6,813,853 | B1 | 11/2004 | Tucker | |
| 7,045,717 | B2 | 5/2006 | Kolvick et al. | |
| 2003/0223232 | A1 * | 12/2003 | Belfer et al. | 362/219 |
| 2005/0276046 | A1 * | 12/2005 | Oppor et al. | 362/249 |
| 2007/0279338 | A1 | 12/2007 | Varrin et al. | |

FOREIGN PATENT DOCUMENTS

| | | | |
|---|---|---|---|
| GB | 2259414 | A | 3/1993 |
| JP | 06-098389 | A | 4/1994 |

* cited by examiner

*Primary Examiner* — David V Bruce
(74) *Attorney, Agent, or Firm* — Aka Chan LLP

(57) ABSTRACT

A method and system for connecting a light emitting apparatus is disclosed herein. The system includes at least two rod assembly connectors, in which each rod assembly connector includes a rod assembly body having a first end and a second end. The first end of one of the rod assembly connectors is configured to connect with the second end of the second rod assembly connector. Further, at least one of the rod assembly connectors includes an attachment mechanism, in which the attachment mechanism is configured to attach to a light emitting apparatus.

25 Claims, 4 Drawing Sheets

ROD ASSEMBLY CONNECTOR FOR MOUNTING LIGHT EMITTING DISPLAY APPARATUSES

CROSS-REFERENCE TO RELATED APPLICATIONS

This application, pursuant to 35 U.S.C. §119(e), claims priority to U.S. Patent Application Ser. No. 60/884,859 filed on Jan. 12, 2007 and entitled "Method for Mounting Light Emitting Panels on Tensioned Cable Systems" in the name of Douglas Franklin, Christopher Varrin, Matthew Ward, Jeremy Hochman, and Jeff Maddox, which is hereby incorporated by reference in its entirety.

BACKGROUND

1. Field of the Disclosure

Embodiments disclosed herein generally relate to light emitting apparatuses and light emitting systems. More specifically, embodiments disclosed herein relate to an improved method and apparatus for mounting light emitting apparatuses and light emitting systems, particularly in which weight and transparency are a concern.

2. Background Art

Display units for entertainment, architectural, and advertising purposes have commonly been constructed from numbers of light emitting elements, such as light emitting diodes ("LEDs") or incandescent lamps mounted onto flat panels. The light emitting elements may be selectively turned on and off to create patterns, graphics, and video displays for both informational and aesthetic purposes. It is well known to construct these displays as tiles or large panels which are assembled in position for a specific entertainment show or event, or also as an architectural or advertising display. Examples of such systems are disclosed in U.S. Pat. Nos. 6,813,853, 6,704,989 and 6,314,669.

As the LED video market expands into new domains, the classic fixed structure of the LED video panel may become a limitation. Designers, architects, and advertisers may desire the flexibility and versatility to use only one or a few products within the rapidly changing environment of the modern era. For example, a panel or modular box system may work well in a stadium score board or as an advertisement on the Las Vegas Strip, but the large panels may have limitations on transparency and weight.

Accordingly, there may be a requirement at an event or within a theatrical production to use a display system that is easily removable, for example, moving the display system in between scenes of a play and as the needs of the production dictates. A display apparatus constructed as a large panel or as a series of solid tiles bolted or permanently fixed together may be very inappropriate for such an application or need. The displays may be large and heavy, and require abundant support machinery, time, and storage space for installation. For example, as disclosed in U.S. Pat. No. 6,704,989, issued to Lutz, an electronic signal display system requires the individual display sections be lifted out of storage cases with a lifting truss and then joined and stacked appropriately for display.

To improve upon these limitations, as described above, many existing products are being developed with a degree of transparency and to weigh less than their panel based counterparts. An example of such a prior art display apparatus is disclosed in U.S. Pat. No. 6,237,290 ("Tokimoto").

Tokimoto discloses a system that effectively integrates the electronic and structural components for use in a building. In this case, the LED ribs are incorporated into a void in the glass wall of the building. However, there may be limitations to the method disclosed in Tokimoto. For example, maintaining the system within the void is complicated. The system disclosed by Tokimoto could be used to back light a graphic on the glass exterior; however, issues with line of sight would prevent the system from acting as a part of the graphic. This may be the result in the alignment of the system and the graphic shifting as the viewer moves. Further, the system may not function as a finished surface and may be difficult to access and maintain.

Another requirement for display systems used for events, such as theatrical productions, is for the display to be easily and quickly configurable to multiple sizes and shapes, thereby allowing the system to suit different installations and logistical constraints. However, while these LED tile systems usually focus on transparency and light weight, the systems generally require frames and ground support structures. For example, the light tile systems often use an extruded aluminum housing that must be attached to a metal frame of some sort. These frames may then be ground supported by an external structure to make use of rigging systems when creating LED tile systems of significant size. As such, these systems generally create an additional cost and tend to work against the goal of creating a transparent and light weight wall system. Accordingly, there exists a need for a support structure that improves upon these prior art support structures for continued development and success within the various light emitting industries.

SUMMARY OF THE DISCLOSURE

In one aspect, embodiments disclosed herein relate to a system for mounting a light emitting display apparatus. The system includes a first and second rod assembly connector, each of the first and second rod assembly connector having a rod assembly body with a first end and a second end. An attachment mechanism is configured to attach to at least one light emitting apparatus and is disposed upon at least one of the first and second rod assembly bodies. Further, a coupler is disposed at the first end of the second rod assembly body. Furthermore, the second end of the first rod assembly body is configured to releasably connect to the coupler of the second rod assembly body.

In another aspect, embodiments disclosed herein relate to a method to connect an array of light emitting apparatuses. The method includes providing a first rod assembly connector and a second rod assembly connector. Each of the first and second rod assembly connectors have a first end and a second end with a coupler disposed at the first end. The method then includes connecting the second end of the first rod assembly connector to the first end of the second rod assembly connector, and providing a first light emitting apparatus and a second light emitting apparatus. Further, the method includes attaching the first light emitting apparatus to the first rod assembly connector and attaching the second light emitting apparatus to the second rod assembly connector.

In yet another aspect, embodiments disclosed herein relate to a method of attaching a rod assembly connector to a light emitting apparatus. The method includes connecting one end of a rigid shaft to one end of a cable, connecting an inner member of a coupler to the other end of the rigid shaft, and disposing an outer member of the coupler over the inner member. The method then further includes disposing a biasing mechanism about the rigid shaft, disposing an attachment mechanism about the rigid shaft, and attaching the rod assembly connector to the light emitting apparatus.

Further, in yet another aspect, embodiments disclosed herein relate to a rod assembly connector. The connector includes a rigid shaft having a first end and a second end and a cable having a first end and a second end, in which the first end of the cable is connected to the second end of the rigid shaft. A coupler is then disposed at the first end of the rigid shaft, in which the coupler includes an inner member and an outer member, in which the inner member includes a recess and is configured to be disposed within the outer member. A ferrule is also disposed at the second end of the cable, a biasing member is disposed about the rigid shaft, and a light emitting apparatus attachment mechanism is disposed about the rigid shaft.

Furthermore, in yet another aspect, embodiments disclosed herein relate to a coupler for connecting a first rod assembly connector with a second rod assembly connector. The coupler includes an inner member and an outer member disposed at an end of the first rod assembly connector. The inner member and the outer member are moveable with respect to one another between an open position and a closed position. In the open position, the inner member is configured to receive an end of the second rod assembly, and in the closed position, the outer member is configured to secure the end of the second rod assembly within the coupler.

Other aspects and advantages of the present disclosure will be apparent from the following description and the appended claims.

DETAILED DESCRIPTION

Figure 1:
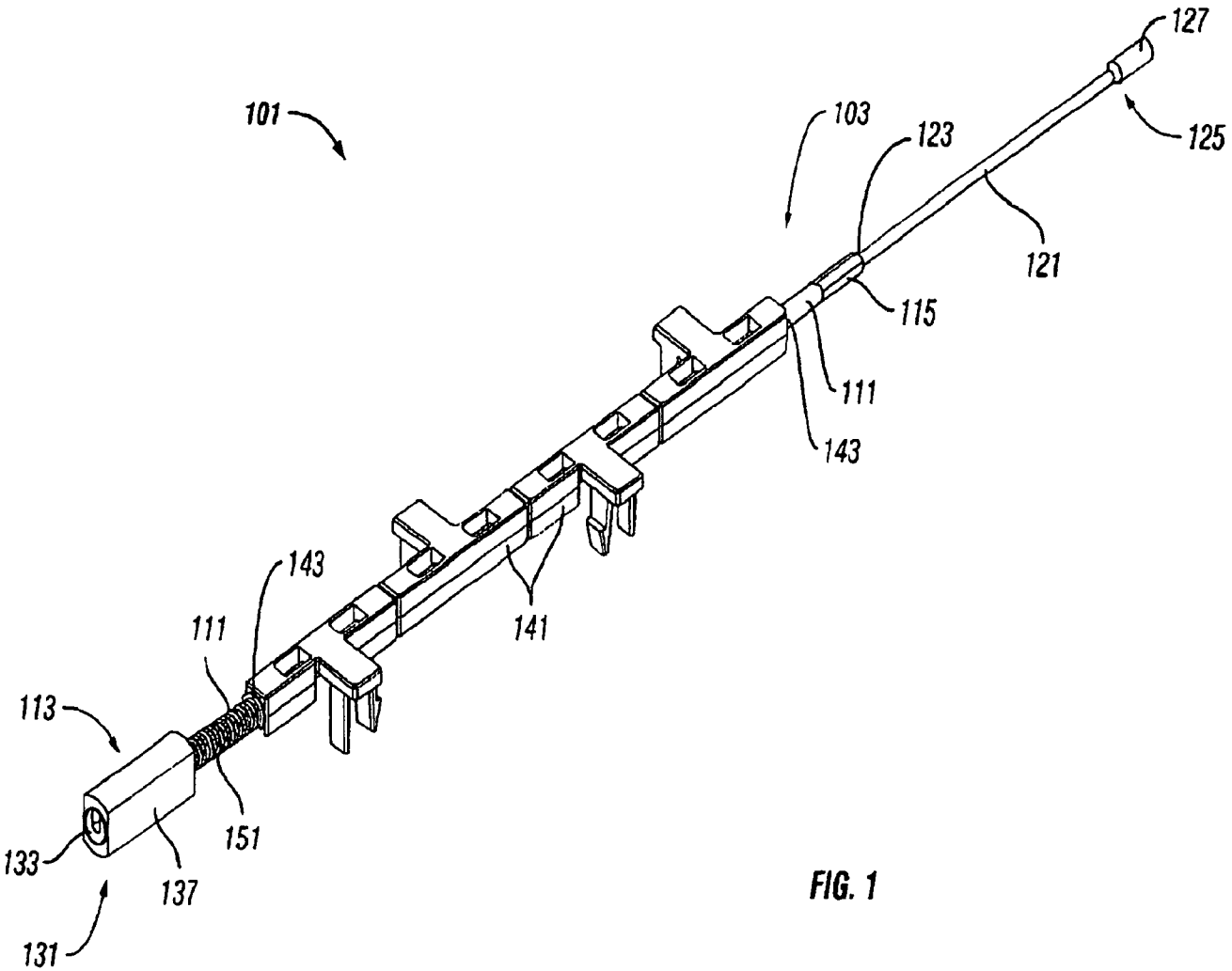
FIG. 1 shows a perspective view of a connector in accordance with embodiments disclosed herein.

Specific embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the present invention may be practiced without these specific details. In other instances, well-known features have not been described in detail to avoid unnecessarily complicating the description.

In one aspect, embodiments disclosed herein generally relate to a rod assembly connector for supporting and mounting light emitting display apparatuses and systems. The rod assembly connector includes a coupler at one end, in which multiple rod assembly connectors may be connected by attaching the ends of the rod assembly connectors with the couplers to the ends of the rod assembly connectors without the couplers. As such, the rod assembly connectors may releasably connect to each other so as to enable the connectors to connected and disconnected as necessary. Further, the rod assembly connector may be formed from a rigid shaft and cable connected to each other, and the coupler connected to the rod assembly connector may include multiple members, such as an inner member and an outer member. The inner member and the outer member of the coupler may be moveable with respect to each other, such as moveable between an open position and a closed position. The moveable operation of the inner and outer members of the coupler may then enable the coupler to connect and disconnect with other rod assembly connectors as necessary.

Referring to FIG. 1, a perspective view of a rod assembly connector 101 in accordance with embodiments disclosed herein is shown. The rod assembly connector 101 has a rod assembly body 103, in which the rod assembly body 103 may include a rigid shaft 111 and a cable 121. Preferably the rigid shaft is comprised of metal, such as steel; however, other similar materials known in the art may be used for the rigid shaft without departing from the scope of the present disclosure. Further, preferably the cable is also comprised of metal, such as steel; however, other materials known in the art, such as composite materials, flat stock, or more traditional webbing materials (e.g., nylon or polypropylene webbing) may be used for the cable without departing from the scope of the present disclosure.

The rigid shaft 111 shaft then has a first end 113 and a second end 115, and correspondingly, the cable 121 has a first end 123 and a second end 125. As shown, the second end 115 of the rigid shaft 111 and the first end 123 of the cable 121 are connected to each other. For example, in one embodiment, to connect the rigid shaft 111 and the cable 121, the second end 115 of the rigid shaft 111 may be hollowed or drilled to contain a hole or recess, in which the first end 123 of the cable 121 may be inserted into the second end 115 of the rigid shaft 111. After insertion, the second end 115 of the rigid shaft 111 and the first end 123 of the cable 121 may be connected to each other by any means known in the art, such as by swaging the ends together in a swaging jig.

The rod assembly connector 101 may then include a coupler 131 disposed at the first end 113 of the rigid shaft 111. The coupler 131 may include an inner member 133 and an outer member 137, in which the inner member 133 may be configured to fit within or be disposed inside, at least partially, with the outer member 137. Further, to correspond with the coupler 131, the second end 125 of the cable 121 may be configured to connect with the coupler 131, or generally another coupler of another rod assembly connector (not shown) that is similar to rod assembly connector 101. For example, a ferrule 127 may be connected to the second end 125 of the cable 121. The ferrule 127 may comprise a hard material, such as metal or any other material known in the art, and may be connected to the second end 125 of the cable 121 by, for example, swaging the ferrule 127 onto the end 125. The ferrule 127 may then be configured to be received within the coupler 131, or a similar coupler of an adjacent rod assembly connector, in which the ferrule 127 would releasably connect the rod assembly connector 101 to the adjacent rod assembly connector (discussed more below).

Further, the rod assembly connector 101 may include one or more attachment mechanisms 141 disposed about, connected to, or formed as part of the rigid shaft 111 or the cable 121. In this embodiment, the attachment mechanism 141 is shown as a hinge disposed about the rigid shaft 111. However, those having ordinary skill in the art will appreciate that any type of attachment mechanism may be used, such as a magnetic, adhesive, or various other mechanical attachment mechanism without departing from the scope of the present disclosure. Regardless, the attachment mechanism is preferably configured to attach to a light emitting apparatus (discussed more below). As shown, when the attachment mechanism 141 is disposed on the rigid shaft 111, one or more retainers 143 may be secured to the rigid shaft 111 to retain and prevent the attachment mechanisms 141 from excessively moving and sliding about the rigid shaft 111. For example, in this embodiment, the retainers 143 are e-rings disposed about and secured to the rigid shaft 111. Preferably, when attaching the e-rings to the rigid shaft 111 of the rod assembly connector 101, grooves may be formed in the rod assembly body 103 at the positions where the e-rings will be installed and secured. However, those having ordinary skill in the art will appreciate that any type of retainer may be used to retain the position of the attachment mechanisms without departing from the scope of the present invention.

Furthermore, the rod assembly connector 101 may include a biasing mechanism 151 disposed about the rigid shaft 111. In this embodiment, the biasing mechanism 151 is shown as a spring; however, those having ordinary skill in the art will appreciate that any type of biasing mechanism may be used. Regardless, the biasing mechanism 151 may be disposed adjacent to the coupler 131, specifically in between the retainer 143 and the coupler 131. This arrangement will allow the biasing mechanism 151 to apply a biasing force against the coupler 131 and bias the outer member 137 of the coupler 131 to maintain a position disposed over the inner member 133 (discussed more below).

Figure 2:
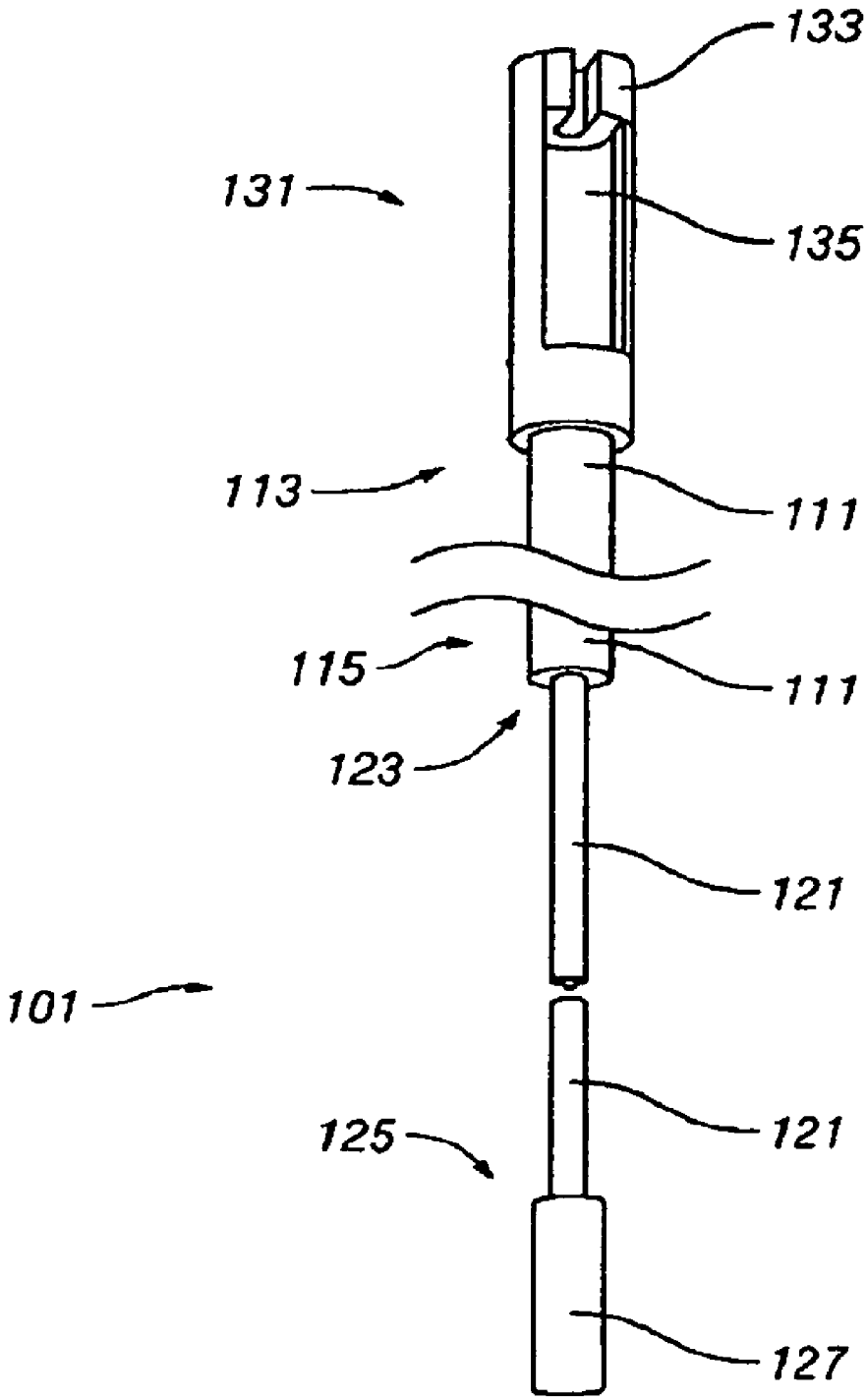
FIG. 2 shows another perspective view of the connector in accordance with embodiments disclosed herein.
Figure 3:
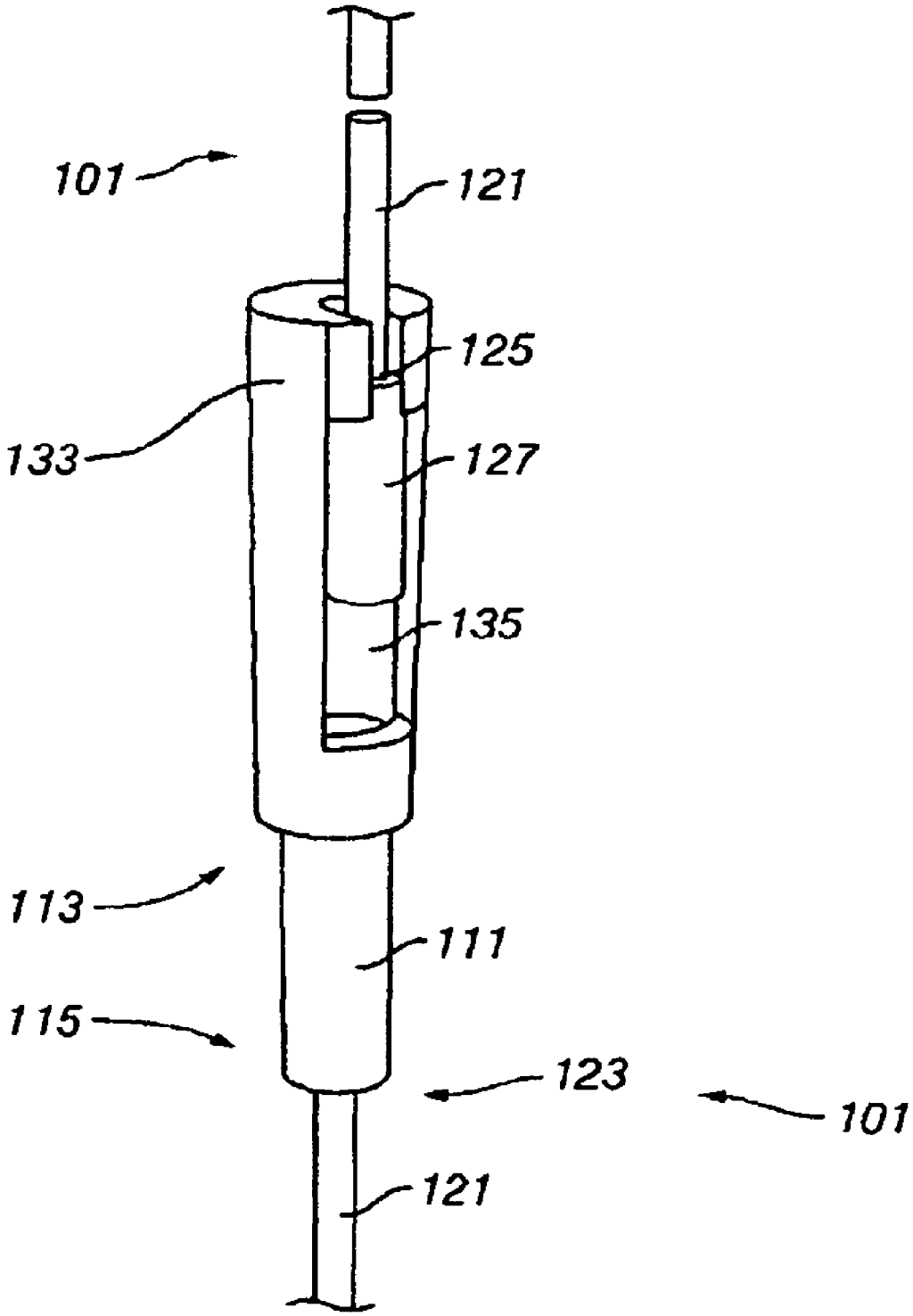
FIG. 3 shows a detailed view of multiple connectors connected to each other in accordance with embodiments disclosed herein.

Referring now to FIGS. 2 and 3, perspective views of the rod assembly connector 101 and multiple rod assembly connectors 101 connected to each other in accordance with embodiments disclosed herein are shown. In these views, the coupler 131 of the connector 101 only includes the inner member 133 for illustrative purposes only, rather than also including the outer member 137 disposed over the inner member 133.

Figure 4:
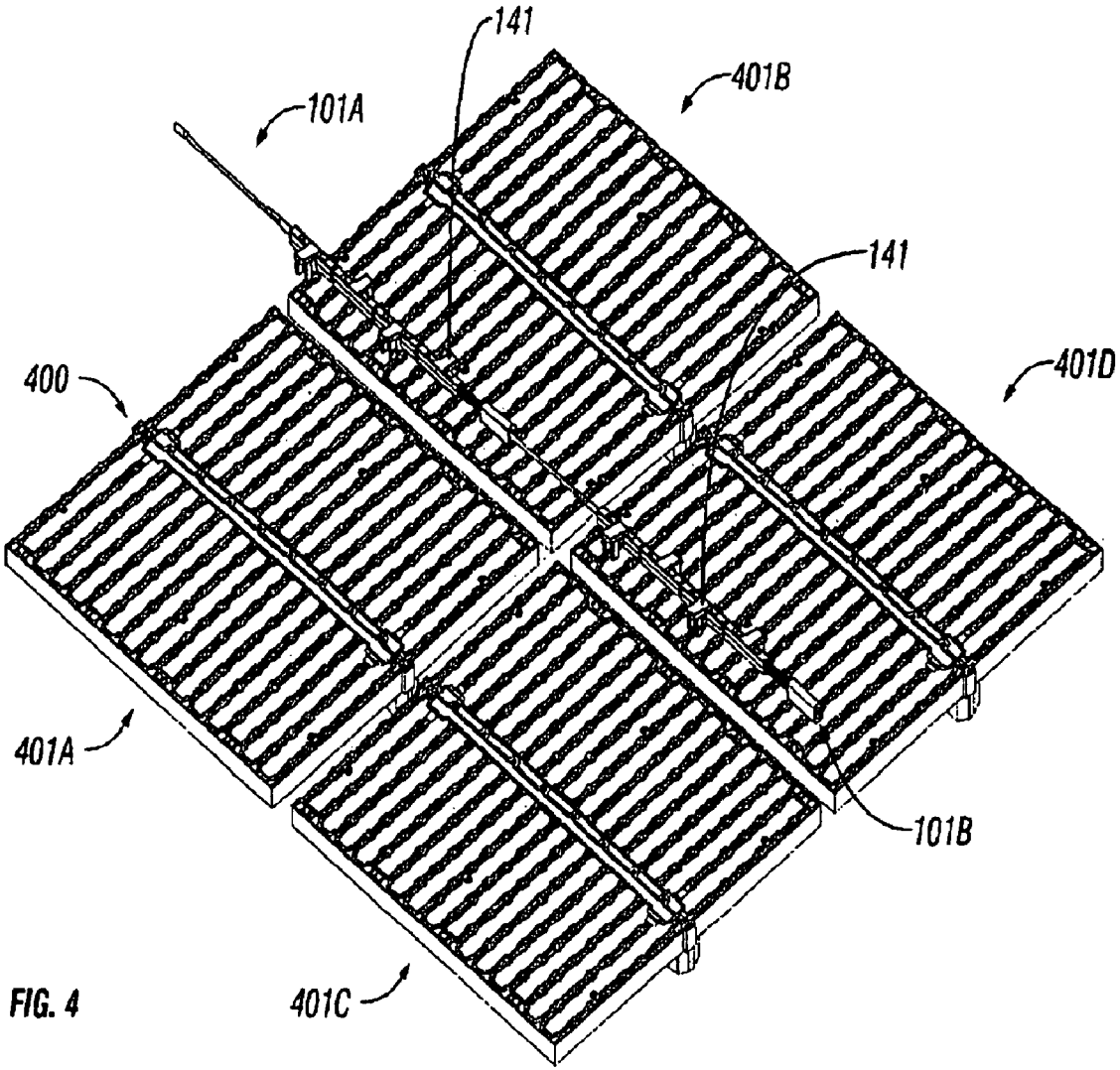
FIG. 4 shows a perspective view of a system of multiple connectors attached to a light emitting apparatus in accordance with embodiments disclosed herein.

As shown, particularly in FIG. 4, the two rod assembly connectors 101 are configured to connect with each other, in which the first end 113 of one of the rod assembly connectors 101 is configured to releasably connect with the second end 125 of the other of the rod assembly connectors 101. For example, the inner member 133 of the coupler 131 may include a recess 135 disposed therein, in which the recess 135 is configured to receive the ferrule 127. Specifically, the ferrule 127 located at the second end 125 of the cable 121 may engage and fit within the recess 135 of the inner member 133 located at the first end 113 of the rigid shaft 111. To secure the ferrule 127 within the recess 135 of the inner member 133, the outer member 137 (shown in FIG. 1) may slide over and be disposed about the outside of the inner member 133 with the ferrule 137 disposed therein. The biasing mechanism 151 (also shown in FIG. 1) may then bias the outer member 137 over the inner member 133 such that the biasing mechanism 151 will keep the outer member 137 positioned over and disposed about the inner member 120. This may maintain an engagement and connection between the ferrule 127 at the second end 125 of the cable 121 of one connector 101 with the inner member 133 of the coupler 131 of the other connector 101. Further, this may also enable the connectors 101 to transfer tensile loads to each other when connected.

Accordingly, the inner member 133 and the outer member 137 of the coupler 131 are moveable with respect to each other. Specifically, as used herein, the inner member 133 and the outer member 137 are moveable between "a closed position" and "an open position." In the closed position, the outer member 137 is positioned over and disposed about the inner member 133 of the coupler 131. As such, the second end 125 of the cable 121 having the ferrule 127 may not be disposed within the recess 135 of the inner member 133. Then, in the open position, the outer member 137 may be moved or slid along the axis of the connector 101 such that the inner member 133 is disposed outside of the outer member 137. In this position, the inner member 133 of the coupler 131 is configured to receive the second end 125 of the cable 121. Specifically, the ferrule 127 disposed at the second end 125 of the cable 121 may be disposed within the recess 135 of the inner member 133. After having the second end 125 of the cable 121 received within the coupler 131 in the open position, the inner member 133 and outer member 137 of the coupler 131 may be moved into the closed position. In the closed position then, the outer member 137 is configured to secure the second end 125 of the cable 121 within the coupler 131. As such, the rod assembly connectors 101 may then be connected together.

Further, with the biasing mechanism 151 disposed adjacent to the coupler 131, specifically between the outer member 137 of the coupler 131 and the retainer 143, the biasing mechanism 151 may bias the coupler 137 into the closed position. This may maintain an engagement of the ferrule 127 with the coupler 131 and, thereby, also may maintain a connection between the two rod assembly connectors 101.

Furthermore, then to release the ferrule 127 and the coupler 131 from engagement and the two rod assembly connectors 101 from connection, the outer member 137 of the coupler 131 may be pushed back against the biasing mechanism 151 to expose the inner member 133. When exposed and disposed outside of the outer member 137, the ferrule 127 of the second end 125 of the other of the two rod assembly connectors 101 may taken out of engagement with the coupler 131 when removed from the recess 135 from the inner member 133. This connection and disconnection enables the rod assembly connectors 101 to releasably connect with each other.

Accordingly, when assembling the connector 101, the inner member 133 of the coupler 110 may first be attached to the first end 113 of the rigid shaft 111. For example, the first end 113 of the rigid shaft 111 may have a male thread formed thereto and the inner member 133 may have a female thread formed therein. The inner member 133 may then threadingly engage the rigid shaft 111. A permanent thread locker, such as a mechanical lock or a locking compound (e.g., Loc-tite) applied to the threads, may also be used to permanently threadingly engage the shaft 111 with the inner member. Then, after connecting the inner member 133 with the rigid shaft 111, the outer member 137 may then be connected to the coupler 131 of rod assembly connector 101 by sliding the outer member 137 over the second end 125 of the cable 121.

Referring now to FIG. 4, a perspective view of a system of multiple rod assembly connectors 101A, 101B connected with each other and attached to a light emitting apparatus 400 in accordance with embodiments disclosed herein is shown. Specifically, in this embodiment, two rod assembly connectors 101A, 101B are connected with each, and these two rod assembly connectors 101A, 101B are attached to a light emitting apparatus 400 having multiple panels 401A, 401B, 401C, 401D. The light emitting apparatus 400 and the multiple panels 401A-401D may include a rib based light emitting apparatus, such as that described in U.S. Patent Publication No. 2007/0279338, which is assigned to the present assignee and herein incorporated by reference in its entirety. However, those having ordinary skill in the art that any type of light emitting apparatus may be attached to the rod assembly connectors, such as a tile based light emitting apparatus, without departing from the scope of the present invention.

Regardless, as described above, the attachment mechanisms 141 that are connected to the rod assembly connectors 101A, 101B are configured to attach to the light emitting apparatus 400. The rod assembly connectors 101A, 101B may be quickly and easily connected to each other, in addition to being attached to the light emitting apparatus 400 having the multiple panels 401A-401D. The rod assembly connector 101A may attach to the panels 401A, 401B, and the rod assembly connector 101B may attach to the panels 401C, 401D. Thus, the panels 401A-401D may be secured and connected to each other through connectors 101A, 101B.

Additionally, the attachment mechanisms 141 disposed on the rod assembly connectors 101A, 101B may enable the panels 401A-401D to rotate with respect to each other. For example, the attachment mechanisms may be able to rotate upon the connectors 101A, 101B. Thus, when the attachment mechanisms are attached to the panels 401A-401D, the panels 401A-401D may be able to rotate. Also, preferably, when the rod assembly connectors are connected to each other, tension may be applied and maintained across the connectors. When in tension, the rod assembly connectors may align, thereby enabling the connectors to more securely attach to the light emitting apparatus.

Further, in another embodiment, rather than only providing mechanical support and being mechanically attached to the light emitting apparatus, the rod assembly connectors may also be electrically connected to the light emitting apparatus. In such an embodiment, power and/or data may be supplied from one or more sources to the rod assembly connectors. This power and data may then be supplied from the rod assembly connectors to the light emitting apparatus. The rod assembly connectors may supply power and data to the entire light emitting apparatus, or may supply power and data to only a select portion of the light emitting apparatus.

Embodiments described herein may provide one or more of the following advantages. First, the present disclosure may provide for a lightweight support structure for a light emitting apparatus. This lightweight support structure may increase the versatility for the use of the light emitting apparatus supported by the rod assembly connectors. Next, the present disclosure may provide for a support structure that is transparent when connected to a light emitting apparatus. This transparency may prevent having the support structure impede any visuals of the light emitting apparatus. Further, the present invention may provide for a support structure of connectors that are easily and quickly connected and disconnected. This quick assembly of the support structure may help reduce the setup time of the support structure and the light emitting apparatus. Finally, the present disclosure may provide for a support structure that is modular to fit multiple types of light emitting apparatuses. The system of rod assembly connectors may be customized, or each rod assembly connector of the system may be customized, to fit light emitting apparatuses of different shapes and sizes.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system for mounting a light emitting display apparatus, the system comprising:

a first rod assembly connector and a second rod assembly connector, each of the first and second rod assembly connectors comprising a rod assembly body with a first end and a second end;

wherein an attachment mechanism configured to attach to at least one light emitting apparatus is disposed upon at least one of the first and second rod assembly bodies;

wherein a coupler is disposed at the first end of the second rod assembly body;

wherein the second end of the first rod assembly body is configured to releasably connect to the coupler of the second rod assembly body.

2. The system of claim 1, wherein at least one of the first and second rod assembly bodies comprises:

a rigid shaft having a first end and a second end; and a cable having a first end and a second end;

wherein the first end of the cable is connected to the second end of the rigid shaft.

3. The system of claim 1, wherein the attachment mechanism comprises a hinge configured to attach to at least one light emitting apparatus.

4. The system of claim 1, wherein the coupler comprises an inner member and an outer member.

5. The system of claim 4, wherein the inner member is connected to the first end of the second rod assembly body and the outer member is disposed about the outside of the inner member.

6. The system of claim 4, wherein the coupler is moveable between a closed position and an open position.

7. The system of claim 6, wherein in the closed position the inner member is disposed within the outer member, and wherein in the open position the inner member is disposed outside the outer member.

8. The system of claim 6, wherein in the open position the inner member of the coupler is configured to receive the second end of the first rod assembly body, and wherein in the closed position, the outer member is configured to secure the second end of the first rod assembly body within the coupler.

9. The system of claim 6, wherein the inner member comprises a recess disposed therein.

10. The system of claim 9, wherein the second end of the first rod assembly body comprises a ferrule.

11. The system of claim 10, wherein the recess of the inner member of the coupler is configured to receive the ferrule when the coupler is in the open position, wherein the outer member is configured to secure the ferrule within the inner member when the coupler is in the closed position.

12. The system of claim 6, wherein a biasing member is disposed about the second rod assembly body and is adjacent to the coupler.

13. The system of claim 12, wherein the biasing member biases the coupler into the closed position.

14. The system of claim 12, wherein the biasing member is a spring.

15. The system of claim 12, further comprising a retainer secured to the second rod assembly body, wherein the biasing member is disposed between the retainer and the coupler, wherein the retainer maintains engagement between the biasing member and the coupler.

16. The system of claim 15, wherein the retainer comprises an e-ring disposed about and secured to the rigid shaft.

17. A method to connect an array of light emitting apparatuses, comprising:

providing a first rod assembly connector and a second rod assembly connector, wherein each of the first and second rod assembly connectors have a first end and a second end with a coupler disposed at the first end;

connecting the second end of the first rod assembly connector to the first end of the second rod assembly connector;

providing a first light emitting apparatus and a second light emitting apparatus; and attaching the first light emitting apparatus to the first rod assembly connector and attaching the second light emitting apparatus to the second rod assembly connector.

18. The method of claim 17, wherein each of the first and second rod assembly connectors comprises:

a rigid shaft having a first end and a second end; and a cable having a first end and a second end;

wherein the first end of the cable is connected to the second end of the rigid shaft.

19. A method of attaching a rod assembly connector to a light emitting apparatus, comprising:

connecting one end of a rigid shaft to one end of a cable;

connecting an inner member of a coupler to the other end of the rigid shaft;

disposing an outer member of the coupler over the inner member;

disposing a biasing member about the rigid shaft;

disposing an attachment mechanism about the rigid shaft; and attaching the rod assembly connector to the light emitting apparatus.

20. The method of claim 19, wherein the connecting one end of the rigid shaft to one end of the cable comprises:

forming a hole in the one end of the rigid shaft;

positioning the one end of the cable within the hole of the rigid shaft; and swaging the cable and the rigid shaft together.

21. A rod assembly connector, comprising:

a rigid shaft having a first end and a second end;

a cable having a first end and a second end, wherein the first end of the cable is connected to a second end of the rigid shaft;

a coupler disposed at the first end of the rigid shaft, wherein the coupler comprises an inner member and an outer member, wherein the inner member comprises a recess and is configured to be disposed within the outer member;

a ferrule disposed at the second end of the cable;

a biasing member disposed about the rigid shaft; and a light emitting apparatus attachment mechanism disposed about the rigid shaft.

22. The rod assembly of claim 21, further comprising a retainer secured to the rigid shaft, wherein the biasing member is disposed between the retainer and the coupler.

23. A coupler for connecting a first rod assembly connector and a second rod assembly connector, the coupler comprising:

an inner member and an outer member disposed at an end of the first rod assembly connector;

wherein the inner member and the outer member are moveable with respect to one another between an open position and a closed position;

wherein in the open position, the inner member is configured to receive an end of the second rod assembly; and wherein in the closed position, the outer member is configured to secure the end of the second rod assembly within the coupler.

24. The coupler of claim 23, wherein in the open position the inner member is disposed outside the outer member, and wherein in the closed position the inner member is disposed within the outer member.

25. The coupler of claim 24, further comprising a biasing member disposed about the first rod assembly connector, wherein the biasing member biases the inner member and the outer member into the closed position.

* * * * *